US006467411B1

(12) United States Patent
Naniwa et al.

(10) Patent No.: US 6,467,411 B1
(45) Date of Patent: Oct. 22, 2002

(54) PRINTING PLATE MOUNTING APPARATUS HAVING GUIDE MEMBER FOR BENDING PLATE TOWARDS CYLINDER

(75) Inventors: Mutsumi Naniwa; Takao Nakayama; Chikashi Oishi, all of Shizuoka (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 09/605,860

(22) Filed: Jun. 29, 2000

(30) Foreign Application Priority Data

Jun. 30, 1999 (JP) ..... 11-186610

(51) Int. Cl.[7] ..... B41L 47/14; B41F 27/12
(52) U.S. Cl. ..... 101/477; 101/415.1
(58) Field of Search ..... 101/477, 415.1, 101/378, 382.1, 383

(56) References Cited

U.S. PATENT DOCUMENTS 5,331,892 A * 7/1994 Seib et al. ..... 101/477
5,511,478 A * 4/1996 Lindner et al. ..... 101/477
5,555,810 A * 9/1996 Stiel ..... 101/477
5,715,752 A * 2/1998 Rother et al. ..... 101/415.1

* cited by examiner

*Primary Examiner*—Leslie J. Evanisko
(74) *Attorney, Agent, or Firm*—Burns, Doane, Swecker & Mathis, LLP

(57) ABSTRACT

A printing plate mounting apparatus (10) mounts a printing plate (70) to a plate cylinder (61). The plate cylinder (61) has a plate head clamping mechanism (62) having upper and lower jaws (62*a*, 62*b*) to position and secure a plate head of a flexible printing plate. In the apparatus (10), a guide member (11, 111) is provided for guiding the flexible printing plate (70) to the plate head clamping mechanism (62). The guide member (11, 111) guides the flexible printing plate (70) so that, at least between the guide member (11, 111) and the plate head clamping mechanism (62), the flexible printing plate (70) is bent toward the plate cylinder (61), or is substantially parallel to the upper face of the lower jaw of the plate head clamping mechanism (62).

10 Claims, 9 Drawing Sheets

PRINTING PLATE MOUNTING APPARATUS HAVING GUIDE MEMBER FOR BENDING PLATE TOWARDS CYLINDER

BACKGROUND OF THE INVENTION

1. Field of the Invention

The present invention relates to a printing plate mounting apparatus, and relates in particular to a printing plate mounting apparatus that precisely aligns a printing plate with a plate cylinder and subsequently secures the printing plate to the plate cylinder.

2. Description of the Related Art

Various well known techniques are employed to mount press plates or printing plates (which are materials of the press plates) onto the plate cylinders of printing apparatuses or exposure apparatuses.

But since the sizes of printing lots are steadily becoming smaller, and since there is a continuing growth in the variety of the matter that is being printed, the need is increasing for printing plates (described in this specification as flexible printing plates) that can be produced by depositing layers of photosensitive substances on inexpensive, easily handled supports composed of materials other than metals (e.g., plastic film or paper).

Since a flexible printing plate is less capable of retaining its size and shape than a printing plate for which a metal is used as a support, i.e., it is less rigid, precisely mounting such a flexible printing plate on a plate cylinder is a very complicated process. For this reason, a number of different techniques have been proposed for the mounting of flexible printing plates on plate cylinders.

FIG. 9 is a schematic diagram illustrating one printing plate mounting apparatus 60 for mounting a flexible printing plate on a plate cylinder in a printing apparatus. The printing plate mounting apparatus 60 comprises: a plate cylinder 61, on which a flexible printing plate 70 composed of a flexible material is to be mounted; a rubber cylinder 65, which is positioned adjacent to the plate cylinder 61; and holding mechanism 51, for holding the flexible printing plate 70.

The plate cylinder 61 is shaped as a cylinder from which part has been removed, in the axial direction, to provide a substantially flat face (hereinafter referred to as a flat face 61*a*) in which a groove is formed. Provided in the groove are a head clamping mechanism 62, for engaging a plate head 70*a* (that is, a tip end of the printing plate 70, the leading end of the flexible printing plate 70; and a tail clamping mechanism 63, for engaging a plate tail 70*b*, the trailing end of the flexible printing plate 70. The clamping mechanisms 62 and 63 respectively include: lower jaws 62*b* and 63*b*, the top face of each of which lies substantially along the same plane as that of the flat face 61*a*; and upper jaws 62*a* and 63*a*, which are supported rotatably, by the lower jaws 62*b* and 63*b* so that the plate head 70*a* and the plate tail 70*b* can be clamped between the upper jaws 62*a* and 63*a* and the lower jaws 62*b* and 63*b*.

A top portion 61*c* is formed between the flat face 61*a* and a curved face 61*b* of the plate cylinder 61. Although not shown, for some cylinders a top portion is formed between the curved face 61*b* and the upper face of the lower jaw 62*b* of the clamping mechanism 62, instead of the flat face 61*a*.

Generally, the portion whereat the flat face 61*a* meets the curved face 61*b* is rounded to form a curved face having a radius of 10 to 20 mm. In this specification, this portion is also called a top portion.

The rubber cylinder 65 can be brought into contact with or separated from the plate cylinder 61, and when the flexible printing plate 70 is mounted around the plate cylinder 61, it can be held and pressed between the rubber cylinder 65 and the plate cylinder 61.

The holding mechanism 51 is provided for the printing plate mounting apparatus 60 because mounting the less rigid flexible printing plate 70 around the plate cylinder 61 would be an extremely difficult and complicated process were it performed by hand. The design of the holding mechanism 51 provides for the positioning of guide rollers 53 at the distal ends of support members 52 projecting outward from a plate member 50*a*.

In the printing plate mounting process, first, an operator loads a flexible printing plate 70 into the holding mechanism 51. Then, as is shown in FIG. 10, while supporting the head 70*a* of the flexible printing plate 70 the operator guides it between the upper and lower jaws 62*a* and 62*b* of the head clamping mechanism 62. The seating of the plate head 70*a* is adjusted by positioning mechanism, such as resister pins or stoppers (not shown) While thus disposed, the plate head 70*a* is secured in place by closing the upper jaw 62*a* in the direction indicated by an arrow A. Thereafter, as the plate cylinder 61 is rotated, the flexible printing plate 70 is wound around the plate cylinder 61.

However, precisely mounting a flexible printing plate 70 on the plate cylinder 61 is still a difficult task. Even when, as is shown in FIG. 10, the head 70*a* of the flexible printing plate 70 is inserted and positioned between the upper and lower jaws 62*a* and 62*b* on the print cylinder 61, as the upper jaw 62 is closed, the head 70*a* tends to be displaced in the direction (the direction indicated by an arrow B) that causes it to be removed from the head clamping mechanism 62.

When the plate head 70*a* is displaced, position adjustment mechanism (not shown), provided for the head clamping mechanism 62, can be used to move the head clamping mechanism 62, at the bottom of the groove in the plate cylinder 61, in several directions so as to adjust the position of the plate head 70*a*. However, at this time, the tail clamping mechanism 63 must be simultaneously moved by the position adjustment mechanism (not shown), and since the operation of the position adjustment mechanism is therefore extremely complex and requires a high degree of skill, this procedure is not practical.

As the result of a thorough study, the present inventors had found the following. When, as is shown in FIG. 10, the portion of the flexible printing plate 70 that is nearer the tail than is the portion that the rotating tip of the upper jaw 62*a* contacts is bent away from the plate cylinder 61, because of the weight of the flexible printing plate 70, a constant force is exerted that removes the plate head 70*a* from a position between the upper and lower jaws 62*a* and 62*b*. Therefore, when the upper jaw 62 is closed in the direction indicated by the arrow A, the flexible printing plate 70 slides across the rotating tip of the upper jaw 62*a*, and is displaced in the direction in which the plate head 70*a* is disengaged from the head clamping mechanism 62 (the direction indicated by the arrow B). That is, since the flexible printing plate 70 is supported by the rotating tip of the upper jaw 62*a*, which acts as a fulcrum as the upper jaw 62*a* is closed and the rotating tip moves toward the plate head 70*a*, the flexible printing plate 70 slides across the rotating tip and is displaced in the direction in which it is removed from the head clamping mechanism 62.

Further, the present inventors have also found that when there is play in the head clamping mechanism 62, the upper jaw 62*a* moves spasmodically when the upper and lower jaws 62*a* and 62*b* are closed, and could result in the displacement of the plate head 70*a*.

SUMMARY OF THE INVENTION

To resolve the shortcomings, it is one objective of the invention to provide a printing plate mounting apparatus that can precisely and easily mount a printing plate on a plate cylinder.

To achieve this objective, according to the invention, a printing plate mounting apparatus comprises:

a plate cylinder, for which a plate head clamping mechanism having upper and lower jaws is provided to position and secure a plate head of a flexible printing plate; and a guide member for guiding the flexible printing plate to the plate head clamping mechanism before the plate head is positioned and secured, wherein the guide member guides the flexible printing plate so that, at least between the guide member and the plate head clamping mechanism, the flexible printing plate is bent toward the plate cylinder, or is substantially parallel to the upper face of the lower jaw of the plate head clamping mechanism.

The forms used for the guide member are not limited, and a guide member can be shaped like a roller or a plate.

A printing plate according to the present invention may include a plate member for which image exposure has not yet performed by an exposure apparatus, and a plate member for which image exposure has been performed, or for which developing has been performed following image exposure, and which can be mounted on the plate cylinder of a printing apparatus. The support member of the flexible printing plate can be composed of a material, other than metal, that is usually employed for offset printing, such as plastic film or paper or a combination of these materials. More specifically, the support member can be a plastic film, such as polyester, polyethylene terephthalate, polyethylene naphthalate or polycarbonate, or a composite sheet formed by the lamination of a plastic sheet, such as polyethylene or polypropylene, and paper. A metal support member may also be employed.

In the thus arranged printing plate mounting apparatus, when positioning and securing a plate head, the guide member steers the flexible printing plate so that, at least between the guide member and the head clamping mechanism, the flexible printing plate is bent toward the plate cylinder, or is substantially parallel to the upper face of the lower jaw, When the flexible printing plate is bent toward the plate cylinder by the guide member, the head of the printing plate is pressed against the upper face of the lower jaw and is not easily displaced. As a result, positioning of the flexible plate head is not adversely affected by the movement of the rotating tip of the upper jaw. When the flexible printing plate is supported by the guide member so it is substantially parallel to the upper face of the lower jaw, the head of the printing plate is not easily displaced while in contact with the upper face of the lower jaw, which is separated from the upper jaw. Similarly, as a result, the positioning of the flexible plate head is not adversely affected by the movement of the rotating tip of the upper jaw.

Therefore, a flexible printing plate can be secured without its precise positioning being adversely affected.

DESCRIPTION OF THE PREFERRED EMBODIMENTS

Figures 1, 1A:
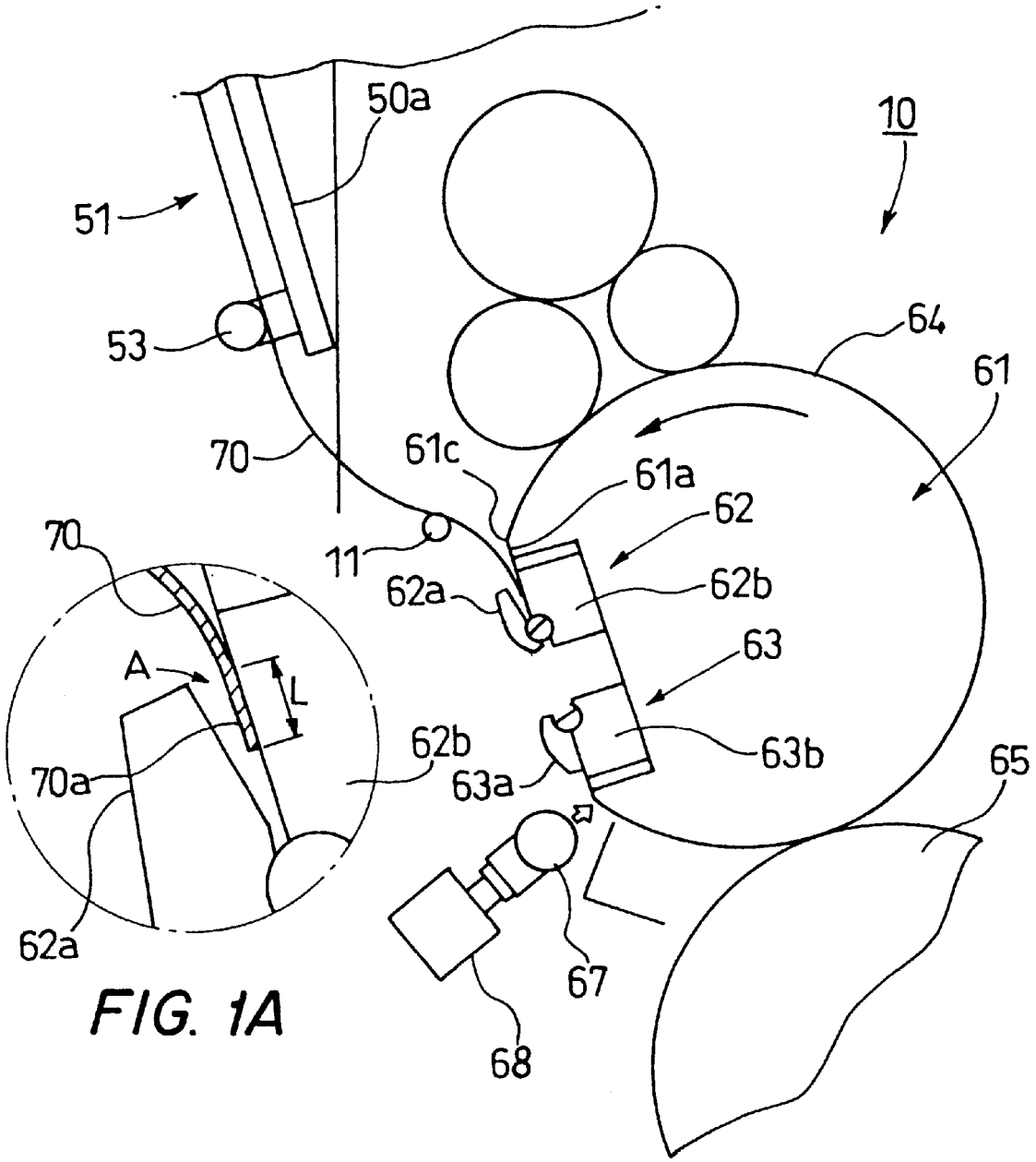
FIG. 1 is a schematic diagram illustrating a printing plate mounting apparatus according to a first embodiment of the invention with FIG. 1A being an enlarged detailed view of a portion of FIG. 1.

The preferred embodiments will now be described in detail while referring to the accompanying drawings. The same or like reference numerals are used to denote components that were previously explained, and for them no additional explanation will be given.

FIG. 1 is a diagram illustrating a printing plate mounting apparatus 10, according to a first embodiment of the present invention, for mounting on a plate cylinder 61 in a printing apparatus a flexible printing plate 70 that has a polyester support member.

As is shown in FIG. 1, the printing plate mounting apparatus 10 comprises: a plate cylinder 61, which has a plate head clamping mechanism 62 and a plate tail clamp mechanism 63; a pressing roller 67 and a rubber cylinder 65, which can be brought into contact with or separated from the outer face of the plate cylinder 61; and holding mechanism 51, for holding a flexible printing plate 70. The pressing roller 67 can be driven against and separated from the plate cylinder 61 by a cylinder 68. Instead of the pressing roller 67, a flat brush having a flat distal end or a pad can be driven against or separated from the plate cylinder 61 by the cylinder 68. In this embodiment, the plate cylinder 61 is rotated or halted by control mechanism (not shown) A cover for shielding the side face of a printing apparatus is employed as a plate member 50*a* of the holding mechanism 51.

A packing sheet 64 for adjusting printing pressure is placed around the outer face of the plate cylinder 61. A sheet used as the packing sheet 64 may be composed of a material that adheres well to the plate cylinder 61, i.e., a plastic, such as polyethylene terephthalate, polypropyrene or polyethylene, a metal, such as aluminum or SUS, paper, synthetic paper, or cloth. At least one side of the packing sheet 64 may have a rough or a viscous face, and the packing sheet 64 may be fitted around the plate cylinder 61 with the rough or the viscous surface facing out.

A guide roller 11 is disposed between a head clamping mechanism 62 of the plate cylinder 61 and the holding mechanism 51 along a path across which the flexible printing plate 70 is transferred. The guide roller 11 guides the flexible printing plate 70, so that between the guide roller 11 and the head clamping mechanism 62 the flexible printing plate 70 is bent/curved toward the plate cylinder 61. In this embodiment, the guide roller 11 is so positioned and so guides the flexible printing plate 70 that a portion L of the flexible printing plate 70, which is clamped between an upper jaw 62*a* and a lower jaw 62*b*, i.e., the portion L that extends from a point whereat it is pressed against the rotating tip of the upper jaw 62*a* to the distal end of the plate 70, contacts the upper face of the lower jaw 62*b*.

An operator loads the flexible printing plate 70 into the holding mechanism 51, passes the flexible printing plate 70 over the guide roller 11 while holding a plate head 70*a* of the flexible printing plate 70, and inserts the head 70*a* between the upper and the lower jaws 62*a* and 62*b* of the head clamping mechanism 62. Then, the seating of the head 70*a* of the flexible printing plate 70 is adjusted by positioning mechanism, such as register pins or stoppers (not shown). At this time, between the guide roller 11 and the head clamping mechanism 62 the flexible printing plate 70 is bent/curved toward the plate cylinder 61. The force with which the head 70*a* is pressed against the upper face of the lower jaw 62*b* is thus generated by the bent/curved flexible printing plate 70. Because of this generated force, the friction effect between the plate head 70*a* and the upper face of the lower jaw 62*b* is increased, and the plate head 70*a* can not easily be shifted. At this time the rotating tip of the upper jaw 62*a* does not contact the plate head 70*a*.

While thus disposed, the upper jaw 62*a* is closed in the direction indicated by an arrow A to secure the head 70*a* of the flexible printing plate 70. Thereafter, the plate cylinder 61 is rotated counterclockwise by control mechanism (not shown) so as to wind the flexible printing plate 70 around it. When the plate cylinder 61 is being rotated and then the control mechanism detects that the plate cylinder 61 has reached a position whereat the pressing roller 67 can contact the flat face 61*a* of the cylinder 61, near the head clamping mechanism 62, the control mechanism halts the rotation of the plate cylinder 61, The pressing roller 67 is brought into contact with the flat face 61*a* of the plate cylinder 61, and forces the flexible printing plate 70 against the outer face of the plate cylinder 61. Then, the plate cylinder 61 is again rotated counterclockwise by the control mechanism (not shown). As a result, in the areas preceding and following the top portion 61*c* of the plate cylinder 61, the flexible printing plate 70 can be forced against the outer face of the plate cylinder 61 by the pressing roller 67. At this time, the pressing roller 67, which is urged toward the outer face of the plate cylinder 61 by the cylinder 68, is moved forward or backward in consonance with the shape of the outer face of the plate cylinder 61.

During the rotation of the plate cylinder 61, after the flexible printing plate 70 is sandwiched between the plate cylinder 61 and the rubber cylinder 65, the pressing roller 67 may be retracted so that it no longer contacts the flexible printing plate 70 In this embodiment, however, the pressing roller 67 is designed to continue to apply pressure to the flexible printing plate 70.

Then, when the flexible printing plate 70 is closely attached to the area in the vicinity of the tail clamp mechanism 63, the control mechanism (not shown) halts the rotation of the plate cylinder 61.

Figure 2:
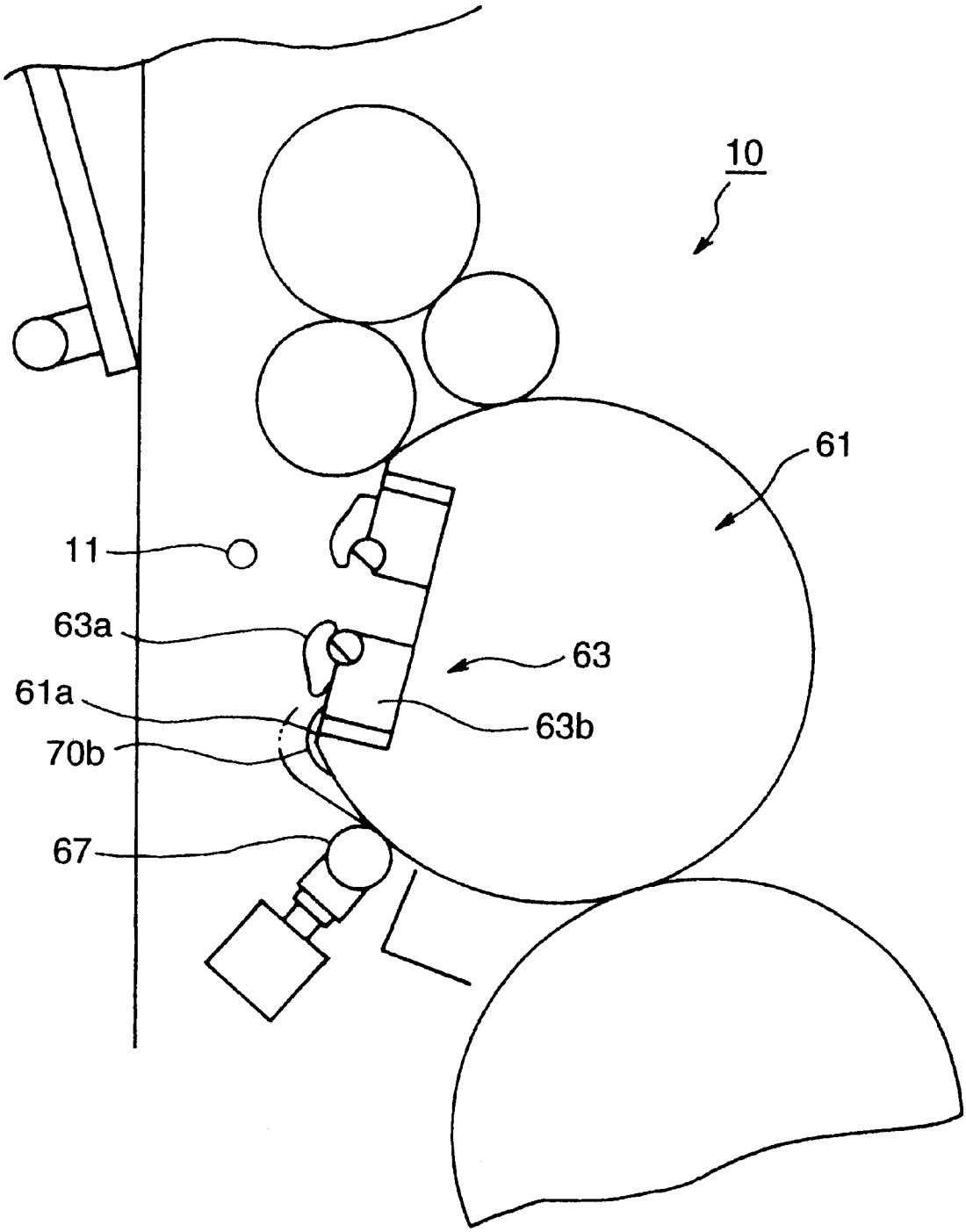
FIG. 2 is a diagram showing an operation performed for the first embodiment.

Following this, as is shown in FIG. 2, the operator bends the portion of the flexible printing plate 70 in the vicinity of the tail 70*b*, and inserts the plate tail 70*b* into the gap between the upper and lower jaws 63*a* and 63*b* of the tail clamping mechanism 63. At this time, the plate tail 70*b* is raised so that it does not contact the flat face 61*a* of the plate cylinder 61 and the upper face of the lower jaw 63*b*. Then, the plate cylinder 61 is again rotated counterclockwise by the control mechanism (not shown), and as a result, in the areas preceding and following the top portion 61*c* of the plate cylinder 61, the flexible printing plate 70 is pressed against the outer face of the plate cylinder 61 by the pressing roller 67, and the print tail 70*b* is closely attached to the flat face 61*a* and the upper face of the lower jaw 63*b*.

Finally, the print tail 70*b* is secured by closing the upper jaw 63*a* of the tail clamping mechanism 63, and the pressing roller 67 is retracted so that it no longer contacts the flexible printing plate 70. In this manner, the flexible printing plate 70 is mounted on the plate cylinder 61.

In the thus arranged printing plate mounting apparatus 10, before positioning and securing the plate head 70*a*, the flexible printing plate 70 travels across the guide roller 11, so that between the guide roller 11 and the head clamping mechanism 62, the flexible printing plate 70 is bent toward the plate cylinder 61. Thus, the force employed to press the plate head 70*a* against the upper face of the lower jaw 62*b* is applied to the flexible printing plate 70, and the friction effect between the plate head 70*a* and the upper face of the lower jaw 62*b* is increased. Therefore, the head 70*a* of the flexible printing plate 70 can not easily be displaced, and when the upper jaw 62*a* is closed, the positioning of the plate head 70*a* is not adversely affected.

The printing plate mounting apparatus 10 can be easily implemented by attaching the guide roller 11 to a conventional printing plate mounting apparatus, and a considerable savings in facility costs can be realized.

Also, since the cover of the printing apparatus is employed as the plate member 50*a* of the holding mechanism 51, the apparatus can be made compactly.

Further, since the pressing roller 67 forces the flexible printing plate 70 against the outer face of the plate cylinder 61 before and after the top portion 61*c* is reached (that is, the top portion near the head clamping mechanism 62 and the top portion near the tail clamping mechanism 63), the flexible printing plate 70, which is attached to the plate cylinder 61, can be more securely mounted and there is no danger of it separating from the outer face of the cylinder 61.

Figures 3, 3A:
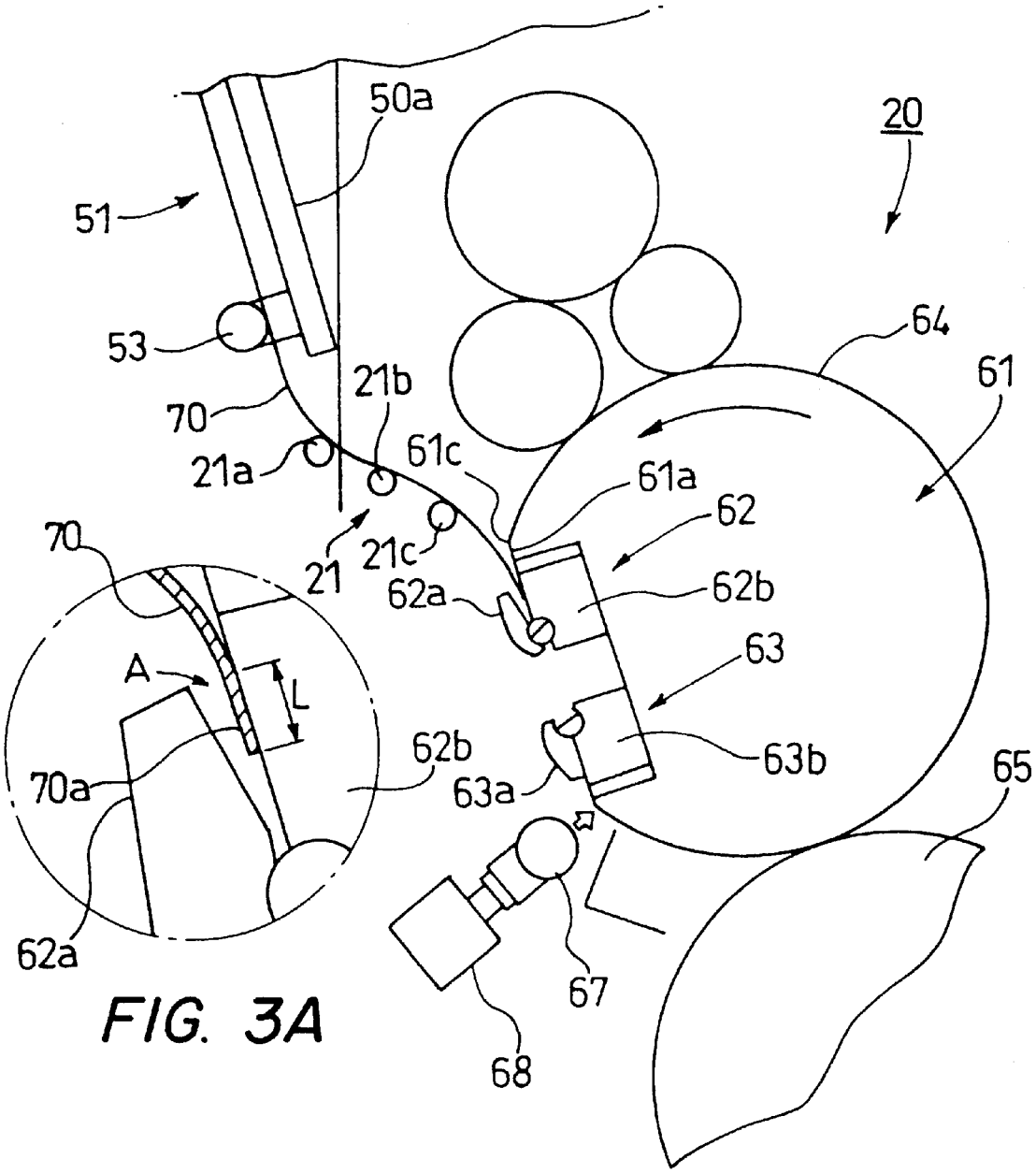
FIG. 3 is a schematic diagram illustrating a printing plate mounting apparatus according to a second embodiment of the invention with FIG. 3A being an enlarged detailed view of a portion of FIG. 3.
Figure 9:
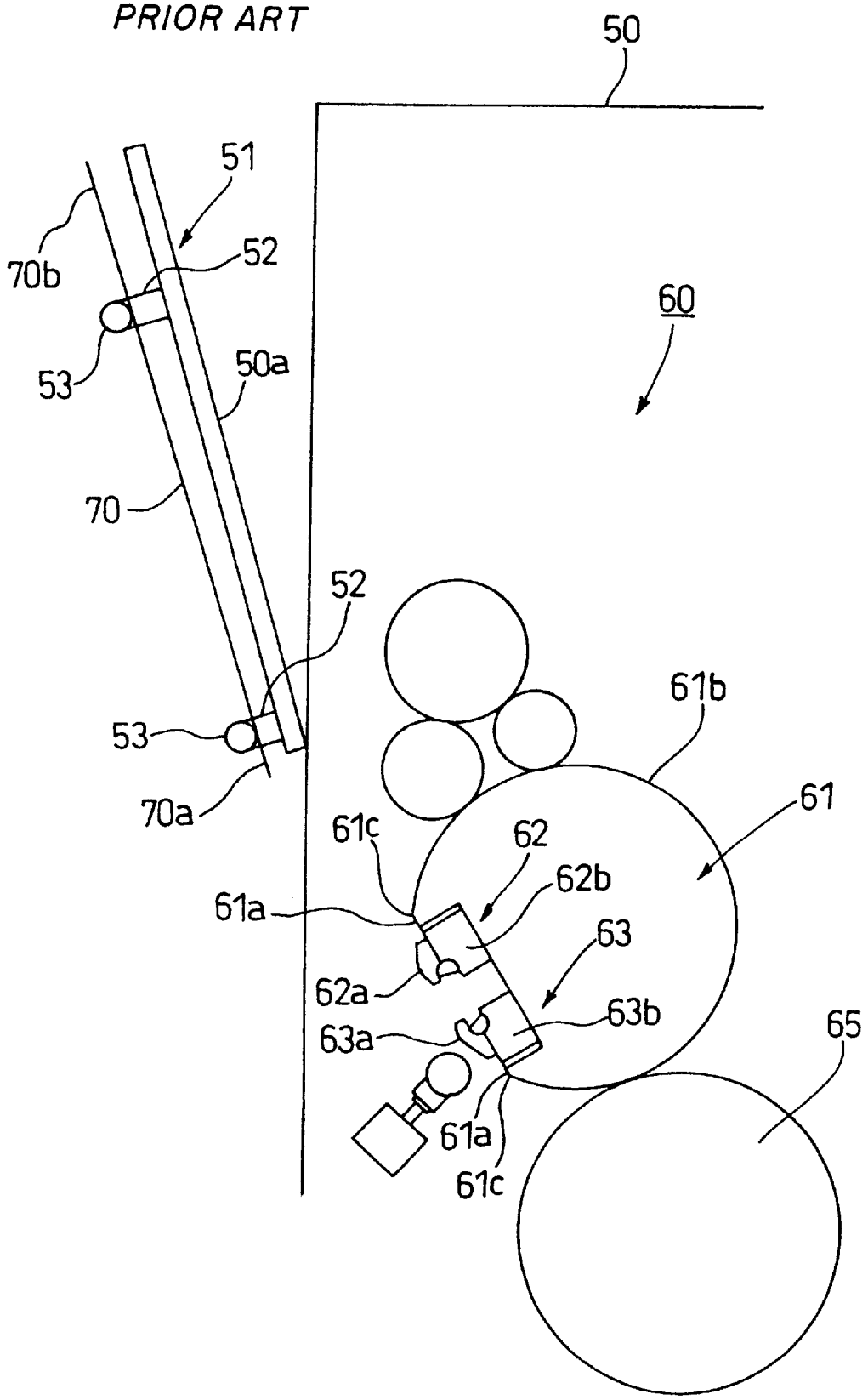
FIG. 9 PRIOR ART
FIG. 9 is a schematic diagram illustrating a conventional printing plate mounting apparatus.
Figures 10, 10A:
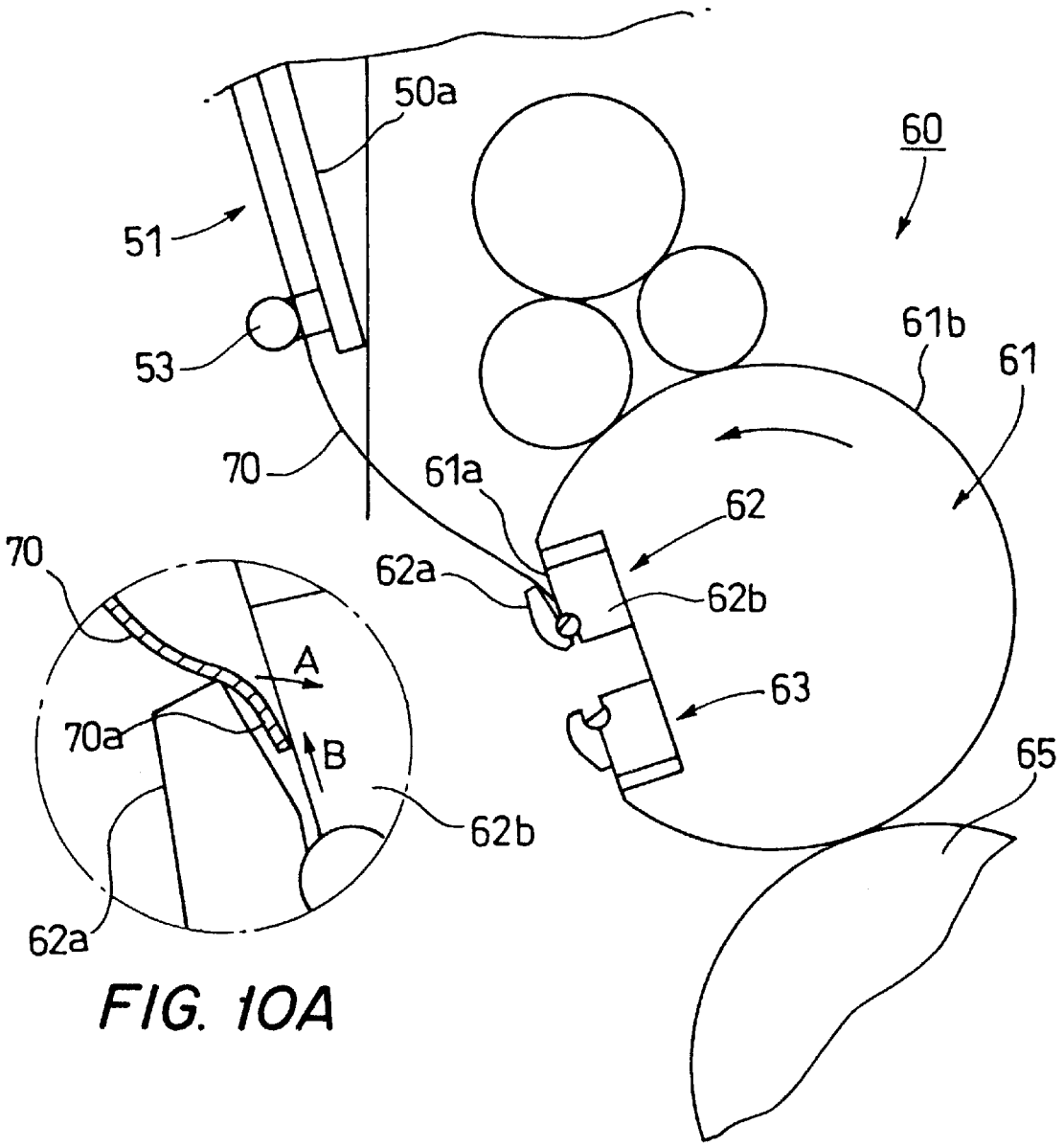
FIG. 10 PRIOR ART
FIG. 10 is a schematic diagram illustrating a conventional printing plate mounting apparatus with FIG. 10A being an enlarged detailed view of a portion of FIG. 10.

FIG. 3 is a diagram illustrating a printing plate mounting apparatus according to a second embodiment. For a printing plate mounting apparatus 20, a guide member 21 includes three rollers, 21*a* to 21*c*. The three rollers 21*a* to 21*c* are disposed along the path a flexible printing plate 70 follows as it is being transported. In this case, the roller 21*a* is positioned outside a printing apparatus, the extent of which is indicated by a vertical line in FIGS. 1–5, 7 and 10 and reference number 50 in FIGS. 6 and 9. It should be noted that while an upper jaw 62*a* is open, a portion L of the flexible printing plate 70, which later is clamped between the upper jaw 62*a* and a lower jaw 62*b*, contacts the upper face of the lower jaw 62*b* but does not contact the upper jaw 62*a*.

In the thus arranged printing plate mounting apparatus 20, the guide member 21 includes multiple members 21*a* to 21*c*, and between holding mechanism 51 and the member 21*a*, which is nearest the holding mechanism 51, the flexible printing plate 70 is bent/curved against a plate cylinder 61. However, since the degree of bending (that is, a radius of curvature) is so small (the curvature radius is large), a plate head 70*a* of the flexible printing plate 70 can be more smoothly guided to a head clamping mechanism 62. Further, since the flexible printing plate 70 is supported by the multiple members 21*a* to 21*c*, there is a reduced probability that the plate head 70*a* will slip off due to the weight of the flexible printing plate 70, and the positioning displacement of the plate head 70*a* can more easily be prevented.

Figure 4:
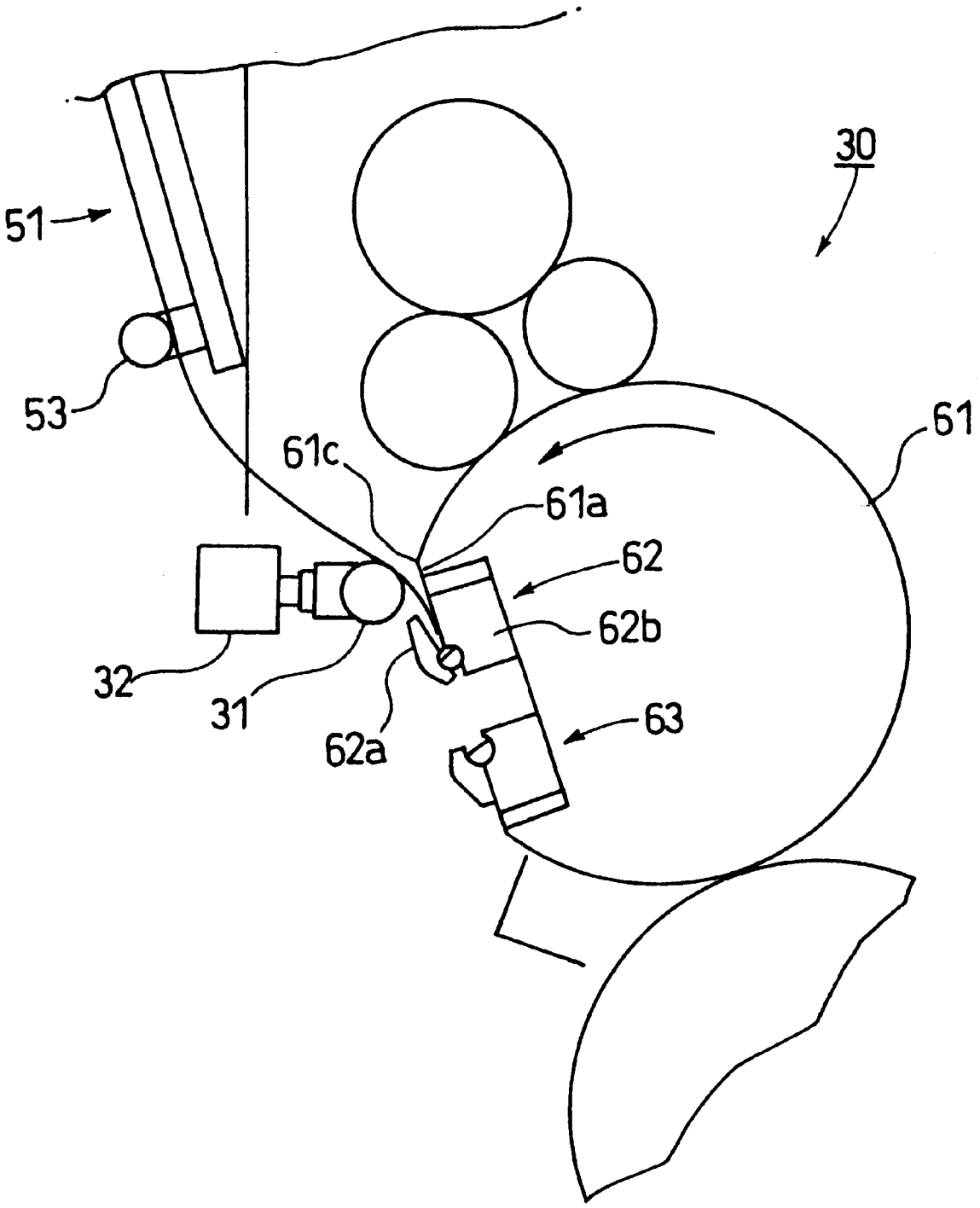
FIG. 4 is a schematic diagram illustrating a printing plate mounting apparatus according to a third embodiment of the invention.

FIG. 4 is a diagram illustrating a printing plate mounting apparatus according to a third embodiment. For a printing plate mounting apparatus 30, a guide member 31 is driven by a cylinder (drive mechanism 32 so that it can be forced against or separated from the outer face of a plate cylinder 61. As is shown in FIG. 4, to position the leading edge of a flexible printing plate 70, the flexible printing plate 70 is carried across the guide member 31, so that between the guide member 31 and a head clamping mechanism 62 the flexible printing plate 70 is bent/curved toward the plate cylinder 61.

Figure 5:
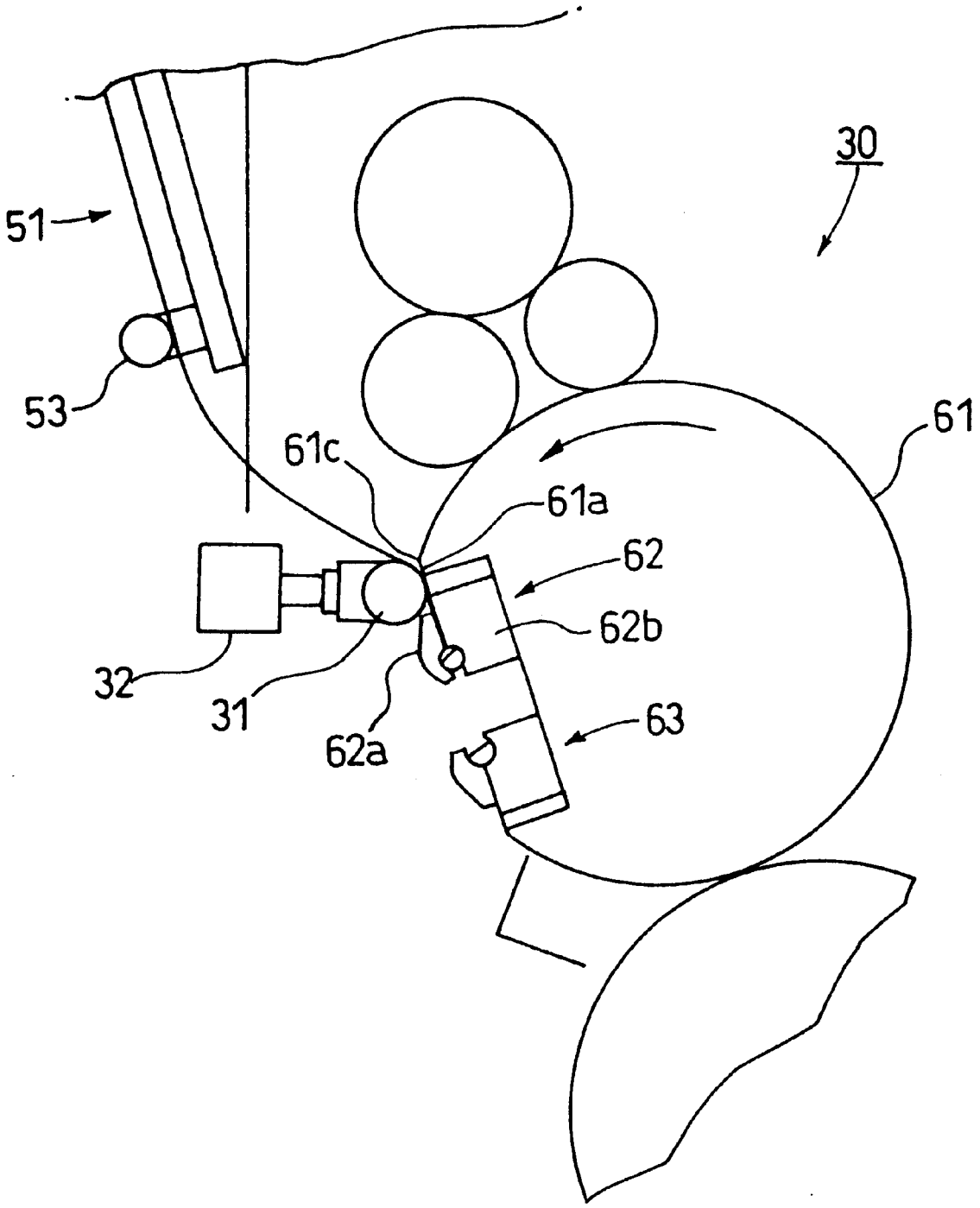
FIG. 5 is a diagram showing an operation performed with the third embodiment.

While disposed as in FIG. 4, the leading edge of the flexible printing plate 70 is secured by closing an upper jaw 62*a*. As is shown in FIG. 5, the cylinder 32 is driven to bring the guide member 31 into contact with a flat face 61*a* of the plate cylinder 61, and to press the flexible printing plate 70 against the outer face of the plate cylinder 61. The plate cylinder 61 is rotated counterclockwise by control mechanism (not shown), and as a result, in the areas preceding and following a top portion 61*c* of the plate cylinder 61, the flexible printing plate 70 can be pressed against the outer face of the plate cylinder 61 by the guide member 31. At this time, the guide member 31, which is urged forward toward the outer face of the plate cylinder 61 by the cylinder 32, is moved forward or backward in consonance with the shape of the outer face of the plate cylinder 61.

Following this, the plate cylinder 61 is again rotated counterclockwise, while the flexible printing plate 70 is wound around it.

In the thus arranged printing plate mounting apparatus 30, the drive mechanism, the cylinder 32, can move the guide member 31 so that it is brought into contact with and separated from the plate cylinder 61. And while the flexible printing plate 70 is wound around the outer face of the plate cylinder 61, the flexible printing plate 70 is pressed against the plate cylinder 61 by the guide member 31, and can be prevented from rising and separating from the plate cylinder 61 in an area in the vicinity of the top portion 61*c*. Therefore, since no component other than the guide member is required to press the flexible printing plate 70 against the top portion 61*c* of the plate cylinder 61, manufacturing costs can be reduced.

Figure 6:
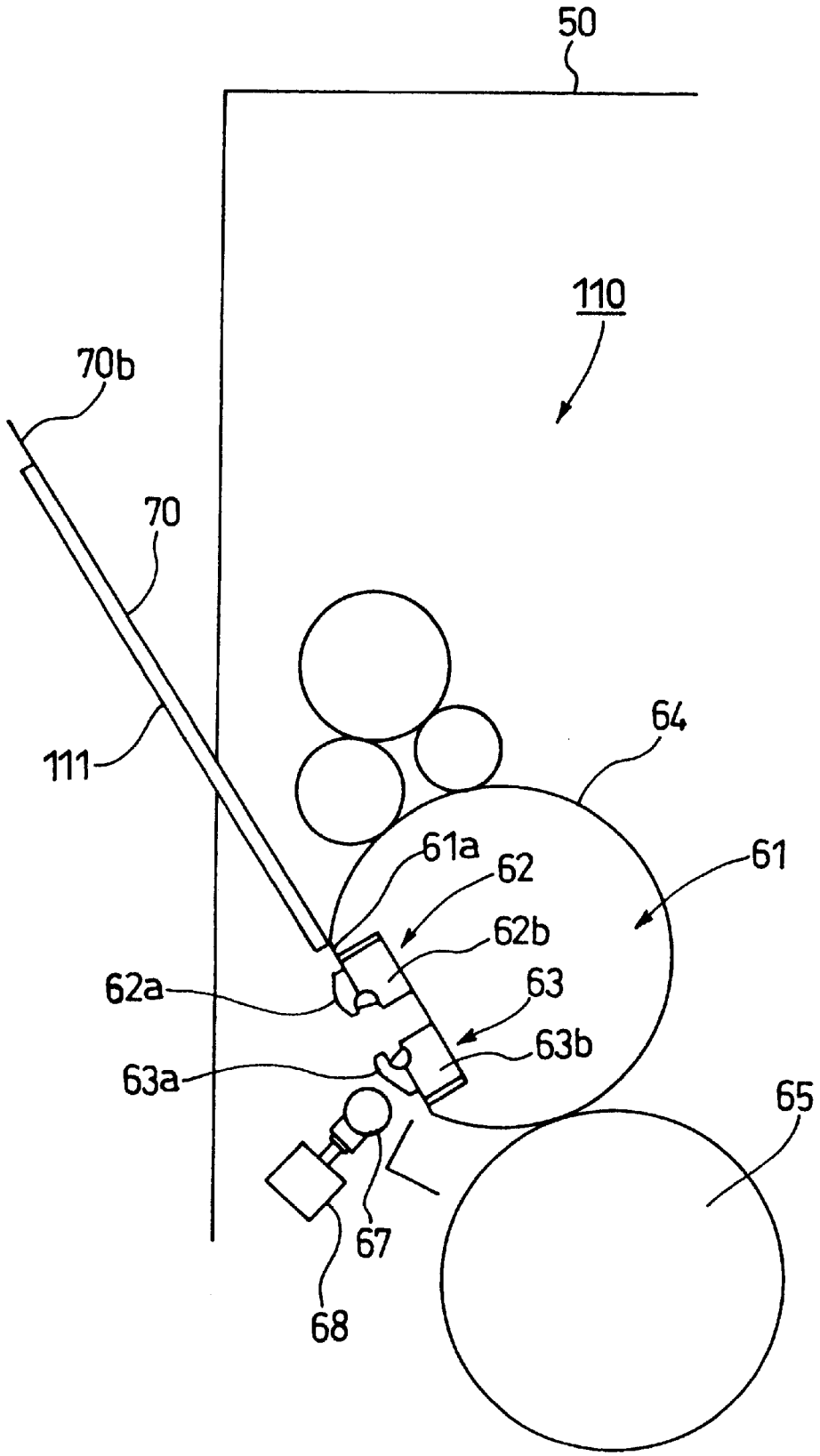
FIG. 6 is a schematic diagram illustrating a printing plate mounting apparatus according to a fourth embodiment of the invention.
Figure 7:
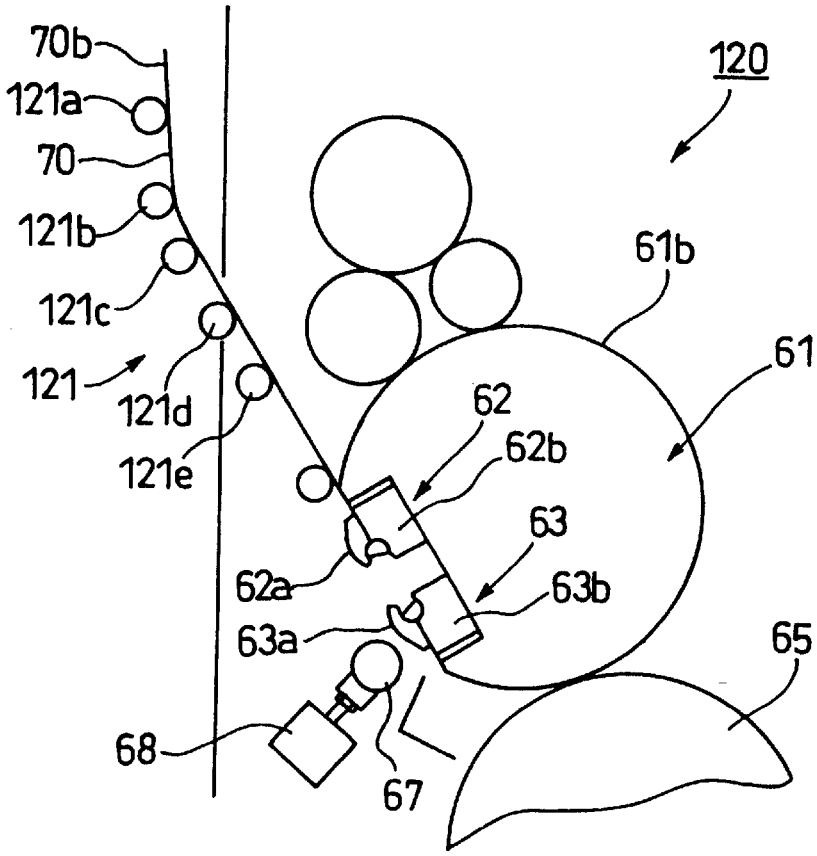
FIG. 7 is a schematic diagram illustrating a printing plate mounting apparatus according to a fifth embodiment of the invention.

FIGS. 6 and 7 are diagrams illustrating printing plate mounting apparatuses according to a fourth and a fifth embodiment of the invention.

For a printing plate mounting apparatus 110 in FIG. 6, a guide member 111 that is constituted by a single plate also serves as holding mechanism. The guide member 111 is inclined so that it is substantially parallel to a flat face 61*a* on a plate cylinder 61 to which the leading edge of a flexible printing plate 70 is to be secured.

For a printing plate mounting apparatus 120 in FIG. 7, a guide member, which includes a plurality of rollers 121*a* to 121*e* also serves as holding mechanism. The guide member 123 conveys a flexible printing plate 70 so that the leading edge of the plate 70 is substantially parallel to a flat face 61*a* on a plate cylinder 61, and so that outside a printing apparatus the flexible printing plate 70 is bent upward. However, like the printing plate mounting apparatus 110 in FIG. 6, the rollers 121*a* to 121*e* can be positioned so that even outside the printing apparatus the flexible printing plate 70 can be maintained substantially parallel to the flat face 61*a* of the plate cylinder 61.

Figure 8:
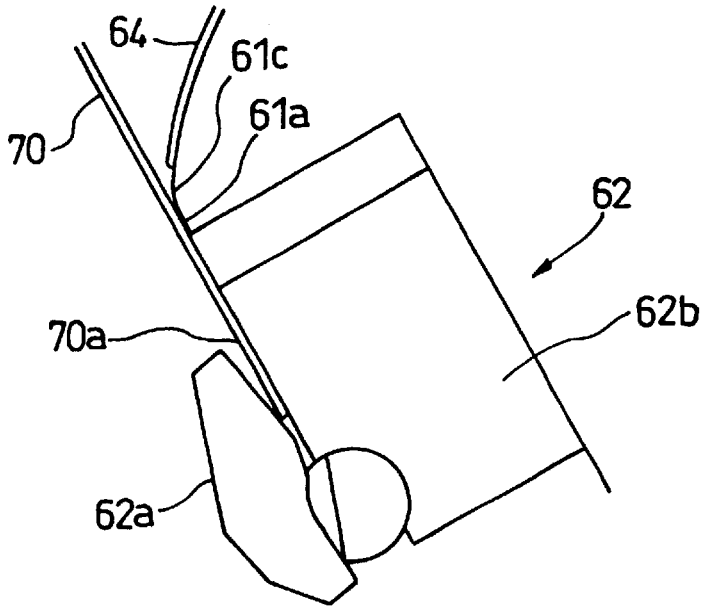
FIG. 8 is a diagram showing an operation performed with the fourth or fifth embodiment.

In these embodiments, the guide member 111 or 121 conveys the flexible printing plate 70 so that between the head clamping mechanism 62 and the end of the guide member 111, or the end of the guide member 121, which is near the plate cylinder 61, the flexible printing plate 70 is substantially parallel to the upper face of the lower jaw 62*b* of the head clamping mechanism 62. As is shown in FIG. 8, the guide member 111, or 121, brings a plate head 70*a* of the flexible printing plate 70 into contact with the upper face of the lower jaw 62*b* of the head clamping mechanism 62, the upper jaw 62*a* of which is held open and does not contact the flexible printing plate 70.

When the thus structured printing plate mounting apparatus 110 or 120 positions and secures the plate head 70*a* of the flexible printing plate 70, the guide member 111, or 121, guides the flexible printing plate 70 so that, at the least, between the guide member 111, or 121, arid the head clamping mechanism 62, the flexible printing plate 70 is substantially parallel to the upper face of the lower jaw 62*b* of the head clamping mechanism 62, and so that the plate head 70*a* of the flexible printing plate 70 is brought into contact with the upper face of the lower jaw 62*b*. Therefore, the positioning of the flexible printing plate 70 is not adversely affected by the movement of the rotating tip of the upper jaw 62*a*, and the flexible printing plate 70 can be precisely positioned and secured to the plate cylinder 61.

The invention is not limited to these embodiments, and can be modified or improved, as needed.

Although in the embodiments a flexible printing plate 70 is mounted on the plate cylinder 61, the invention can be applied for a modification that provides for the mounting of a plate that includes a metal support member.

As is described above in detail, according to the invention, to position and fix the leading edge of a printing plate, a guide member guides the printing plate so that, at the least, between the guide member and the head clamping mechanism the printing plate is bent toward the plate cylinder, or so that the printing plate is substantially parallel to the upper face of the lower jaw. Since the leading edge of the printing plate is pressed against the upper face of the lower jaw by the guide member, or since the leading edge of the printing plate is brought into contact with the upper face of the lower jaw, which is separated from the upper jaw, the printing plate is not easily displaced, and therefore, the printing plate can be secured while it is precisely positioned on the plate cylinder.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A printing plate mounting apparatus comprising:

a plate cylinder having a plate head clamping mechanism which is provided with upper and lower jaws operable to position and secure therebetween a plate head of a flexible printing plate; and a guide member disposed upstream of said plate cylinder operable to guide said flexible printing plate toward said plate head clamping mechanism, said guide member being positioned in such a manner that a portion of said printing plate passing between said guide member and said plate head clamping mechanism is bent toward said plate cylinder so as to form a convex surface facing said plate cylinder, to thereby bring a part of said plate head into face-contact with an upper face of the lower jaw.

2. A printing plate mounting apparatus according to claim 1, wherein said guide member comprises at least one roller disposed in a path along which the flexible printing plate travels.

3. A printing plate mounting apparatus according to claim 2, wherein said guide member further comprises a cylinder operable to move said at least one roller towards or away from said plate cylinder or hold the at least one roller against said plate cylinder.

4. A printing plate mounting apparatus according to claim 1, wherein said guide member comprises a guide plate which is extended substantially parallel to the upper face of the lower jaw of said plate head clamping mechanism.

5. A printing plate mounting apparatus according to claim 1, wherein said guide member comprises a plurality of rollers disposed in a path along which the flexible printing plate travels.

6. A printing plate mounting apparatus according to claim 5, wherein said plurality of rollers are aligned in a line.

7. A painting plate mounting apparatus according to claim 6, wherein said line is extended substantially parallel to the upper face of the lower jaw of said plate head clamping mechanism.

8. A printing plate mounting apparatus according to claim 1, wherein said guide member is positioned in such a manner that a portion of said printing plate passing between said guide member and said plate head clamping mechanism is bent toward said plate cylinder so as to form a convex surface facing said plate cylinder between said guide member and the point of contact with said plate head clamping mechanism.

9. A printing plate mounting apparatus according to claim 8, wherein said guide member (11) is positioned in such a manner that a portion of said printing plate (70) passing between said guide member (11) and said plate head clamping mechanism (62) is bent toward said plate cylinder (61) so as to form a convex surface facing said plate cylinder (61) and also to press a tip end **(70*a*) of the printing plate (70) to the upper face of said lower jaw (62*b*) of said plate head clamping mechanism (62)**.

10. A printing plate mounting apparatus according to claim 1, wherein said guide member (11) is positioned in such a manner that a portion of said printing plate (70) passing between said guide member (11) and said plate head clamping mechanism (62) is bent toward said plate cylinder (61) so as to form a convex surface facing said plate cylinder (61) and also to press a tip end **(70*a*) of the printing plate (70) to the upper face of said lower jaw (62*b*) of said plate head clamping mechanism (62)**.

* * * * *